US006832419B1

(12) United States Patent
Williamson et al.

(10) Patent No.: US 6,832,419 B1
(45) Date of Patent: Dec. 21, 2004

(54) METHOD OF MAKING PILE FABRIC

(75) Inventors: Curtis Brian Williamson, LaGrange, GA (US); Michael Keller, Simpsonville, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/613,240

(22) Filed: Jul. 3, 2003

(51) Int. Cl.[7] ..... D06M 10/00
(52) U.S. Cl. ..... 28/159; 28/166
(58) Field of Search ..... 28/159, 160, 161, 28/162, 163, 166, 165, 145, 147; 26/2 R; 139/2, 3, 391, 392, 395, 396, 399, 404; 112/410, 411; 428/85, 89, 92, 93, 94, 97; 264/210.1, 210.7, 210.8, 211.15, 211.14, 290.5

(56) References Cited

U.S. PATENT DOCUMENTS

| | | | | | |
|---|---|---|---|---|---|
| 2,401,828 | A | * | 6/1946 | Kahil | 442/187 |
| 2,705,880 | A | * | 4/1955 | Kinzinger et al. | 66/191 |
| 2,837,809 | A | * | 6/1958 | Muller | 28/159 |
| 2,979,883 | A | | 4/1961 | Waltz | |
| 3,293,723 | A | * | 12/1966 | Evans | 28/159 |
| 3,678,142 | A | * | 7/1972 | Dubach | 264/482 |
| 3,764,448 | A | * | 10/1973 | Nisbet et al. | 428/94 |
| 3,849,159 | A | * | 11/1974 | Palmer et al. | 8/497 |
| 4,153,660 | A | | 5/1979 | Reese | |
| 4,355,592 | A | * | 10/1982 | Tajiri et al. | 112/410 |
| 4,472,220 | A | * | 9/1984 | Dawbarn et al. | 156/72 |
| 4,539,242 | A | * | 9/1985 | Sasaki et al. | 428/92 |
| 4,617,208 | A | * | 10/1986 | Cadenhead, Sr. | 428/17 |
| 5,464,677 | A | * | 11/1995 | Corbin et al. | 428/95 |
| 5,983,470 | A | | 11/1999 | Goineau | |
| 6,254,961 | B1 | * | 7/2001 | Chuah | 428/97 |

OTHER PUBLICATIONS

U.S. patent application Ser. No. 10/438,497 entitled "Pile Fabric," filed May15, 2003 (Milliken File No. 5607) to inventors Keller et al. (copy enclosed).

U.S. patent application Ser. No. 10/613,241 (Milliken File No. 5635) "Pile Fabric and Heat Modified Fiber and Related Manufacturing Process," filed Jul. 3, 2003 to Keller et. al. (copy enclosed).

* cited by examiner

*Primary Examiner*—Amy B. Vanatta
(74) *Attorney, Agent, or Firm*—Terry T. Moyer; John E. Vick

(57) ABSTRACT

A pile fabric may be employed in automotive, furniture upholstery and other applications. Pile surfaces on such fabrics may be provided in tufts, or collections of fiber bundles, arranged in rows upon a base portion. Fabrics and methods of making fabrics which minimize the average amount of void space between respective tufts or rows are disclosed. Fabrics which provide more effective overall fabric coverage upon base portions of the fabric are described. A method of "heat shocking" fibers during the drawing of said fibers to pre-stress the fiber and thereby produce a fabric having greater bloom or bulk is disclosed. Providing differential heat history to predetermined portions of the fiber may be a suitable manner of obtaining a fiber which can be used to form a fabric having greater bulk.

20 Claims, 6 Drawing Sheets

PRIOR ART FABRIC

METHOD OF MAKING PILE FABRIC

BACKGROUND OF THE INVENTION

Pile fabrics such as velours, velvets, and the like may be formed using a "sandwich" method in which two fabrics substrates are woven or knitted in face to face relation with the pile ends interlocking. A cutting blade slits through the center of the "sandwich", cutting the pile ends to produce two separate pieces of fabric. Each cut piece provides a multiplicity of yarns project outwardly away from the base so as to define a user contact surface.

A common application for pile fabrics is in the covering of seating structures and other interior components for use within transportation vehicles. Such fabric is also used in the manufacture of furniture.

In forming a pile fabric around portions of a seating structure, the fabric bends around sharply defined radius portions of the surface being covered. Such bending typically causes the pile-forming yarns to spread apart, undesirably exposing a portion of the underlying base fabric. That is, bending of the fabric causes a visual "break" in the surface coverage provided by the pile yarns. Such a break in surface coverage is undesirable. To promote the uniformity of surface coverage around a sharp bend it may be possible to utilize extremely high pile density across the base fabric. However, such high pile densities may not be completely effective in avoiding pile separation. Furthermore, high pile density fabrics are expensive and relatively heavy, which is undesirable.

Another potential solution is to utilize so-called "textured" yarns in forming a pile across a fabric. Textured yarns are made using processes such as false twisting and the like so as to impart a textured irregular surface character along the length of the filaments within the yarns. This process of manufacture bulks the filaments along their length. The original uniform character of the filaments within the textured yarns is substituted with an irregular random character in textured yarns. While such textured yarns may provide beneficial surface coverage characteristics, they may pose problems in fabric manufacture while also adding complexity and expense due to the texturizing processes required. In addition, the use of textured yarns may give rise to an enhanced potential for the occurrence of single end defects and non-uniformity in dyeing, which are undesirable.

Conventional Pile Fabrics

In FIG. 1, there is illustrated a typical prior art pile fabric 40 formed from multi-filament flat untextured yarns. As illustrated, in this construction the pile fabric 40 includes a base fabric layer 20 formed by the cooperating ground yarns 12, 14 and an outwardly projecting pile layer 50 formed by an arrangement of tufts 51 including the cooperating pile-forming fibrous elements of pile yarns 30, 32. In such a construction, the pile-forming fibrous elements forming the pile portion 50 are generally of a substantially equivalent height across the surface of the pile fabric 40. Moreover at the base of the prior art pile fabric 40, there are peak shaped voids 52 between the tufts 51 (i.e. rows) projecting away from the base fabric 20. As will be appreciated, upon bending the pile fabric 40 around a sharp radius such as a bolster portion of a chair, the pile-forming fibrous elements in the tufts may reveal undesirable voids at the radius of curvature, due in part to the excessive size of the peak shaped voids 52.

BRIEF DESCRIPTION OF THE DRAWINGS

The present invention will now be described by way of example only, with reference to the accompanying drawings.

DETAILED DESCRIPTION OF THE INVENTION

Figure 1:
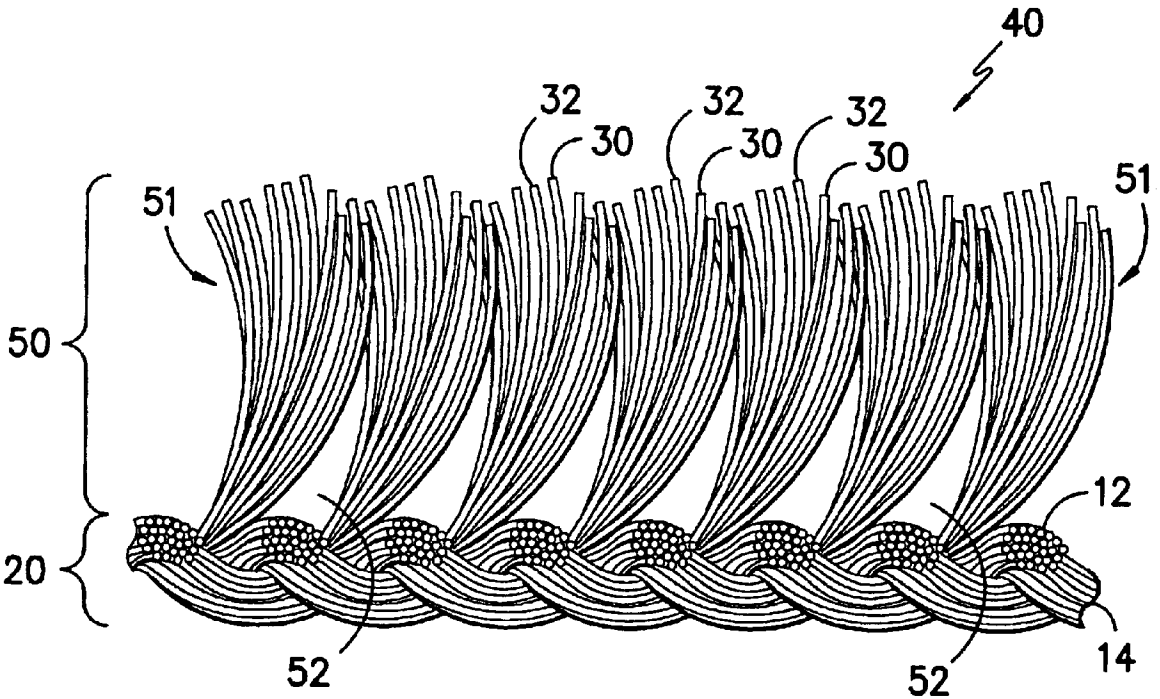
FIG. 1 illustrates a cut-away cross-section of a typical prior art pile fabric, as described above.

Multi-filament yarn is formed from a multiplicity of discrete filaments which are combined together in a defined manner to yield a desired yarn construction having a predefined cross-sectional geometry and diameter. The individual filaments typically are formed from collections of long chain polymers that are expelled through a spinneret so as to impart only a partial degree of orientation to the molecular chains. Thus, the filaments (and the yarns formed from the filaments) are only partially oriented in the longitudinal direction. Accordingly, such yarns (called partially oriented yarns, "POY") typically are suitable for further longitudinal orientation by passage through a yarn drawing operation. Fibers employed in the practice of the invention may be of essentially base material, including for example polypropylene, nylon, polyester, or other synthetic or natural materials.

According to one practice of the invention, different levels of heat shrinkage potential may be imparted to the pile-forming fibrous elements. Heat "shocking" in the practice of the invention is the application of heat to fibers of a yarn in one or more short bursts. Heat shocking locks fibers into a meta stable structure which can then be relaxed during further heat treatment of the fiber. Heat shocking can be used to reduce the overall heat "history" of a fiber while increasing the differential heat across the cross-sectional width of the fiber. Fibers which have been subjected to heat shocking may be referred to herein as "heat shocked fibers", or "pre-stressed fibers", or "pre-stressed yarn". The temporary application of heat may result in a greater differential shrinkage, and higher bulk, upon final heating during subsequent processing steps. Higher bulk may result in better coverage of tufts upon backing portions of the fabric. Bulk can be decreased by increasing the heat exposure time or the temperature of the heater employed, thus allowing complete and variable control of the bulk applied in the heat treatment.

In some prior art applications, the high shrinkage has been achieved using various co-polymers or other techniques. These prior processes may result in higher diffential shrinkage without increase in bulk. However, in the practice of the invention, there is instead a suprisingly greater and increased amount of bulk, and an increase In shrinkage. This bulk and higher shrinkage is desirable.

In addition, pile forming fibrous elements which undergo shrinkage subsequently bloom laterally outward are desirable. This is shown and described below in connection with FIG. 5 and FIG. 7, for example. This lateral blooming of the tuft upon final heating results in a substantially reduced void area between the tufts in comparison conventional pile products formed from flat (non-textured) yarns. Such reduced void area corresponds to enhanced surface coverage across the fabric base, which is a desirable feature.

In the invention, a fabric of continuous filament non-textured yarn is provided. The fabric includes a base portion, a pile portion, and a plurality of tufts. The tufts may comprise groups of continuous filament non-textured fibers. In general, the tufts are arranged upon the base portion in rows, and the tufts provide a degree of surface coverage upon the base portion such that the rows when viewed from an edge perspective provide an average void area between rows of less than about 0.41 square millimeters, at a gauge of about 32 tufts per inch, employing fibers having a fiber cross-sectional aspect ratio of about 1.

In the geometry of the tufted pile fabric made from the inventive self-bulking yarns, at least two fabric features affect the fabric cross-sectional void area that is measured. The first feature is the gauge of the tufts, or number of tufts per inch in the construction. The second feature is the fiber cross-sectional aspect ratio of the fibers in the tuft.

Higher gauges will result in a lower fabric cross-sectional void area, even for prior art fabrics. However, the use of the inventive self-bulking yarns in the invention will improve the fabric "cover". Specifically, with a fiber cross-sectional aspect ratio of about one, one may expect to achieve a fabric cross-sectional void area below about 90 percent of A, where A is given in square millimeters by:

$$A=0.26-0.0308*(G-44) \quad \text{(Equation \#1)}$$

wherein G is the gauge measured in tufts/inch.

In another embodiment, one practicing the invention may achieve in a fabric a cross-sectional void area below about 80 percent of A. In yet another embodiment, one would expect to achieve a fabric cross sectional void area below about 70 percent of A.

The fiber cross-sectional aspect ratio is the ratio of the length of the longest line between any two points on the boundary of a fiber cross section and the length of the longest line ending on the boundary of fiber cross-section perpendicular to that line. As an example, a round fiber has a fiber cross-sectional aspect ratio of about one (1), and a wave cross section fiber available from Nanya Fiber Company has a fiber cross-sectional aspect ratio of about four. Higher fiber cross-sectional aspect ratios generally result in fibers with lower bending moduli, and thus experience the self-bulking effect to a greater degree. For example, with a gauge of about 44, one can expect to achieve a fabric cross-sectional void area below about 90 percent of A', where A' (i.e. prior art or conventional product) is given in square millimeters by:

$$A'=0.26-0.0767*(AR-1) \quad \text{(Equation \#2)}$$

wherein AR is the fiber cross-sectional aspect ratio defined above.

In another embodiment of the invention, one would expect to achieve a fabric cross-sectional void area below about 80 percent of A'. In yet another embodiment of the invention, one would expect to achieve a fabric cross-sectional void area below about 70 percent of A'.

However, the invention can be practiced at essentially any fiber cross-sectional aspect ratio, and at essentially any gauge. In one embodiment of the invention, one may achieve a fabric cross-sectional void area of less than A", where A" is measured in square millimeters and is given by:

$$A''=0.26-0.0308*(G-44)-0.0767*(AR-1) \quad \text{(Equation \#3)}$$

and G Is the gauge measured in tufts per inch, with AR representing the cross sectional aspect ratio defined above.

In another embodiment of the invention, one would expect to achieve a fabric cross-sectional void area below about 80 percent of A". In yet another embodiment, one would expect to achieve a fabric cross-sectional void area below about 70 percent of A".

The above equations 1–3 set forth herein are obtained by linear extrapolation of the data in Table 3, Samples D, E, and F, which are further described below.

In a first application of the invention, an average void area of less than about 0.41 square millimeters may be achieved, using a fiber having gauge of about 32 tufts per inch, employing a fiber aspect ratio of about 1. In other applications of the invention, using these fibers, the average void area may be less than about 0.35 square millimeters. In yet other applications using such fibers, the average void area may be less than about 0.21 square millimeters.

In general, the practice of the invention makes it possible to reduce the average void area between rows or tufts, resulting in a superior product. The invention may provide an average void area between rows or tufts which is between about 0.21 and about 0.35 square millimeters, in some embodiments One important factor to observe in the application of the invention is that fabrics can be manufactured in various constructions which are defined by the number of tufts per inch, or commonly known as "gauge" in the industry. By the term "gauge" herein, it is meant the number of needles per inch in the warp knit machine. Unless otherwise indicated herein, the data generated herein refers to a 32 gauge double needle bar knit machine construction.

Furthermore, the invention also may be defined by reference to an aspect ratio. The term "aspect ratio" referenced herein incorporates the customary usage of this term, which indicates the cross-sectional length of the fiber divided by the cross-sectional width of the fiber. For purposes of this specification, unless indicated otherwise, a generally round cross-sectional fiber was employed which provides an aspect ratio of about 1.

In one particular embodiment, the fabric is made as a double needle bar knitted fabric, but could in other embodiments be constructed as a clip knit fabric, or as a woven fabric, or in other configurations.

The fibers of the invention are, in general, characterized by a substantially uniform cross-sectional geometry along their length. The cross-sectional geometry of the fibers is typically round. In some applications, the geometry in cross-section is in the form of a multi-lobal wave. In general, fibers with a higher aspect ratio tend to have a lower bending modulus, and thus have increased lateral bloom, which is desirable.

In the practice of the invention, it is possible to provide a method of forming a pile fabric of continuous filament non-textured yarn. A continuous filament non-textured yarn is heated and drawn simultaneously. A base portion is provided, and the continuous filament non-textured yarn is formed into a plurality of tufts upon the base portion so that the tufts and base portion define a fabric structure. Subsequently, the fabric structure is heated to a temperature level that is typically above the glass transition temperature of the yarn so that the yarn shrinks towards the base portion relative to the second pile yarn. The yarn "blooms" outwardly in the final product, thereby providing enhanced coverage of the base portion, which is highly desirable.

One embodiment of the invention provides a method and process of forming a yarn or fiber. Further, a fiber having differential shrinkage across the width of the fiber may be formed in the practice of the invention. A method of making a fiber which is pre-stressed by heat shocking is also disclosed.

A method of making a fiber is disclosed where high shrinkage can be made by at least two methods. One method which may be employed is to draw at high draw ratio wherein a fully oriented fiber results, thereby making a fiber having more internal crystals and a higher oriented amorphous region. This is not, by itself however, necessarily a reliable guarantee of achieving high shrinkage. A second method would actually be underdraw the fiber while heating, wherein the fibers left in a meta stable state with limited heat form crystal-like regions within the fiber. This can result in a relatively low orientation and a higher amorphous region upon subsequent heating. This is a process of "self-texturing"or "pre-stressing" a fiber.

The temperature at which the yarn is heated and drawn simultaneously will vary depending upon the particular application. For certain yarn types, it may be at a temperature of greater than about 150 degrees Centigrade. For other applications, the heating and drawing step may be accomplished at a temperature of greater than about 200 degrees Centigrade. In yet other embodiments, the heating and drawing step may be accomplished at a temperature of about 215 degrees Centigrade, or greater. For some applications, it has been found that 210–220 degrees Centigrade is desirable for heat shocking fibers of the yarn.

For purposes of this specification the term "underdrawn" may be used. By "underdrawn" it is meant that the fiber is still partially oriented and has a residual elongation of at least about 40%.

When drawing the yarn, the draw may occur simultaneously to the heat shocking step. Drawing may be conducted at a heater contact time of about 0.063 seconds or less during the heat shocking of the yarn or fiber. By heat or contact time it is meant that the amount of time that the yarn or fiber is subjected to heating. Heat or contact time is effected by the draw speed of the yarn and also by the length or dimensions of the actual heater itself. Thus, some applications may use a relatively high draw speed and a relatively large dimensioned heater to produce an effect that is roughly or approximately equivalent to a lower draw speed using a heater having a shorter dimension. Thus, the invention is not limited to a heater of any specific dimension, or to any particular drawing speed, but instead is defined more appropriately by reference to heat or contact time during the draw.

In other applications, the drawing step is conducted at a heat or contact time of at most about 0.056 seconds. In yet other applications the heat or contact time employed would be at most about 0.052 seconds. Still further applications of the invention may utilize a heater contact time of no greater than about 0.047 seconds, or even less.

Hot Drawing

Shocking the Yarn or Fiber

Figure 2:
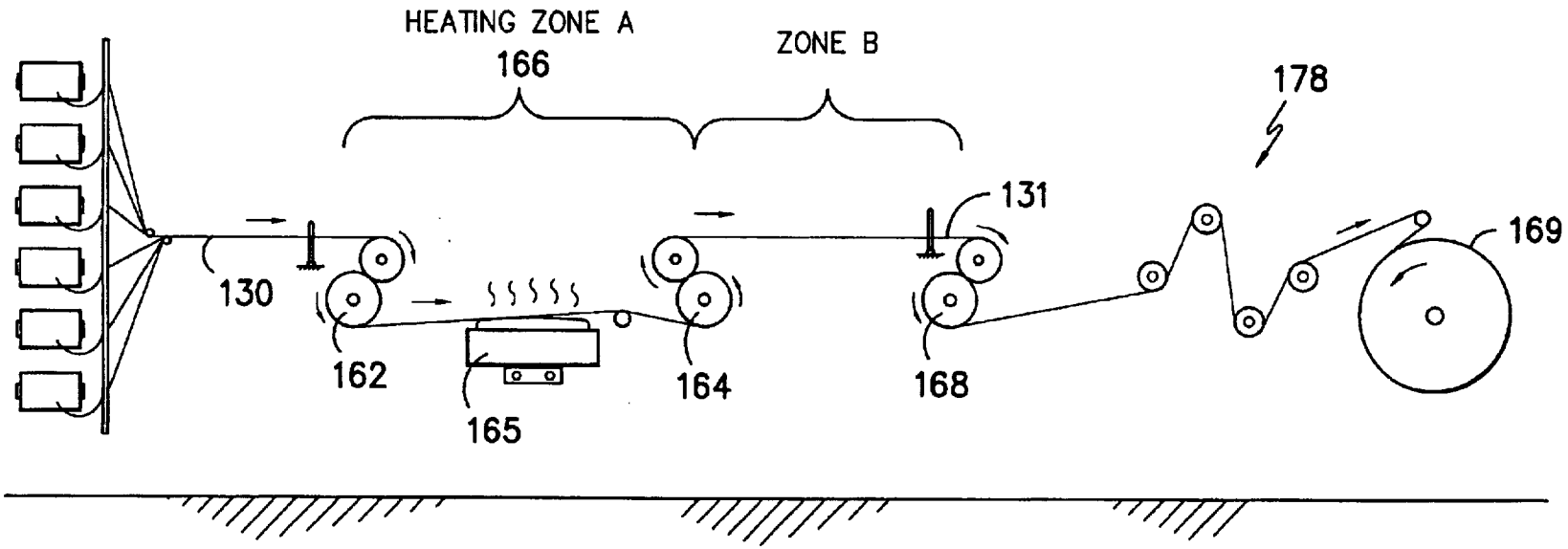
FIG. 2 illustrates schematically a practice for imparting a heat shock to a set of pile-forming yarns in the practice of the invention.

The yarns 130 (see FIG. 2) are "heat shocked" or "pre-stressed" by quickly passing the yarns through a heating zone 166, indicated in FIG. 2 as heating Zone A. The heating zone 166 (Zone A) includes a heater 165 between the nip rolls 162 and nip rolls 164. A further set of nip rolls 168 further receives the yarn at the right side of FIG. 2 in Zone B, which is typically not a heating zone.

The heat shocking procedure employed in Zone A may employ a draw ratio of about 1.0 to about 1.60 below the draw ratio required to yield a fully-oriented fiber. The nominal draw ratio required for full orientation of the fiber, which could be variable, and may be about 1.70 in some applications. In another applications the draw ratio might be between 1.40 to 1.60. In yet other applications, the draw ratio might be between 1.20 to 1.40. Still further applications of the invention, the draw ratio might be between 1.00 to 1.20. The hot draw ratio is measured as the speed of the nip rolls 164 divided by the speed of the nip rolls 162. In one particular embodiment, a draw ratio of 1.14 is employed in the heating zone 166 (Zone A). Typically, heat is applied in Zone A, but in alternate embodiments of the invention it may be desirable to provide further heating in Zone B as well, depending upon the particular application.

The pre-stressed yarn 131 which emerges from Zone B passes to tension dancer 178, and is then delivered to a take-up roll 169 for storage or subsequent incorporation into a pile of a fabric.

The speed of yarn traveling to nip rolls 168 in Zone B may be greater than about 450 yards per minute. In some embodiments of the invention, the speed of yarn traveling to nip rolls 168 will be as great as 600 yards per minute, or even more. The speed of the yarn is chosen to provide the appropriate amount of heater contact time, as further discussed herein. The overall percent shrinkage of the yarn which has been hot drawn or heat shocked in this way according to the practice of the invention may be as much as about 6–12% or even up to 40% or more. It is possible to vary the shrinkage percentage by varying the degree of heat applied to the fibers of the yarn in Zone A, and by varying the time spent by the yarn in Zone A. This is also a function of draw speed. This process may be facilitated by regulating the running speed of the apparatus which passes the yarn through the heated Zone A during the heat shocking step of the method, and by varying the length of heater 165, or both.

The pile fabric may be brushed down and heat set at about 300 to about 420 degrees Fahrenheit. Further, the pre-stressed yarn may be dyed in a dye jet process at an elevated temperature of about 266 degrees F. for about 30 minutes. This dying process typically further contributes to yarn shrinkage.

Figure 3:
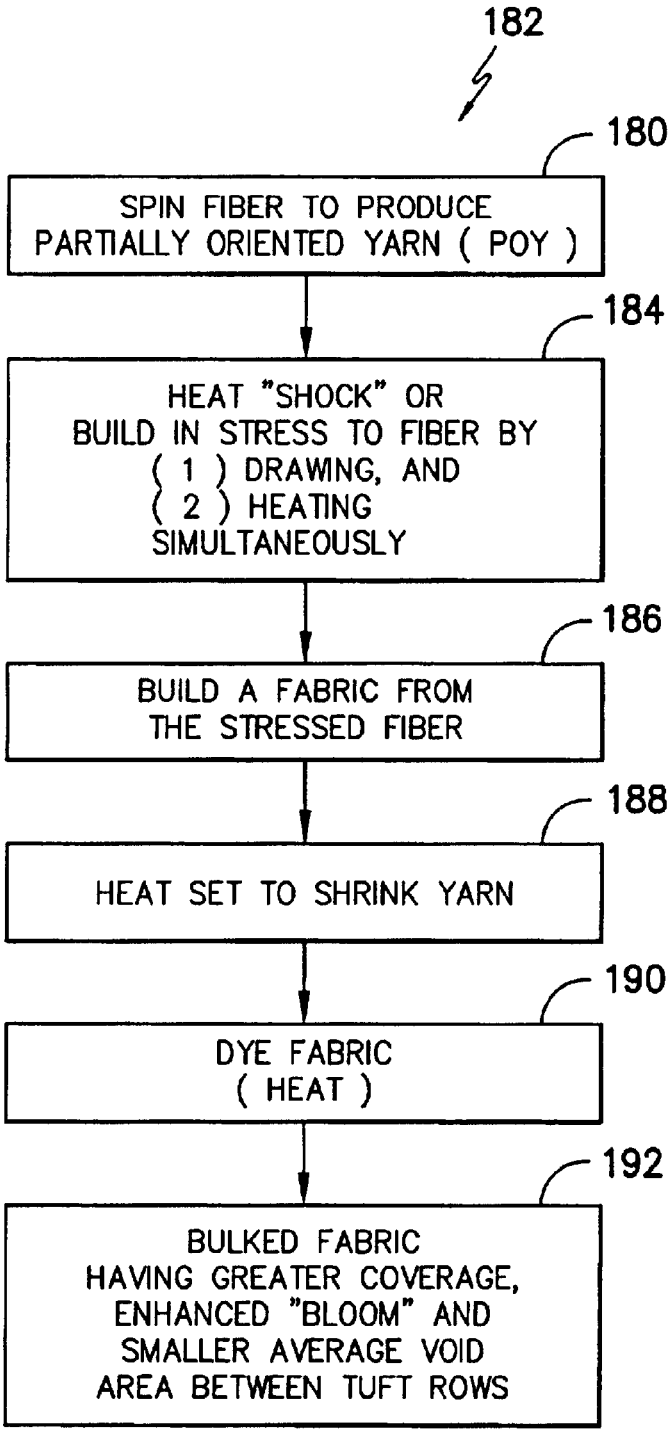
FIG. 3 shows an overview of a method that may be employed in the practice of the invention.

FIG. 3 shows a schematic flow diagram 182 in one method of practicing the invention. First, a partially oriented yarn (POY) is purchased or made. Usually, this yarn has been spun to partially orient the fibers in the yarn, as shown in step 180. Then, stress is built into the fiber at step 184 by drawing and heating the fiber simultaneously, to "heat shock" the fibers, as previously discussed. Step 186 relates to the subsequent building of a fabric using the stressed, heat shocked fiber. Step 186 could include knitting, as in a double bar knitting machine, or other methods of building a fabric. Step 188 shows a next step of heat setting the yarn, thereby shrinking the yarn. This may be in a "brush/heat set" manner, in which the yarn is heated to temperatures of about 300–420 degrees Fahrenheit, resulting in bulking of the yarn. Then, a further step may include the dying of the fabric using a jet dye process 190 which results in further yarn bulking. The resulting fabric as in step 192 reveals a bulked pile material having greater overall coverage of the fabric base with a smaller average void area between tuft rows on the fabric, and enhanced bloom, as will be further described below.

In some applications of the invention, the finished pile fabric may be subjected to an optional face treating process which may serve to cut, carve, or print geometric designs upon the fabric pile for maximum design and consumer appeal.

Of course, it is to be understood that fabric formation apparatus of various types may be employed. Essentially any other pile forming apparatus may be employed in the practice of the invention. By way of example only, and not by way of limitation, other pile forming practices may include single needle bar knitting, velour weaving, tufting, stitch bonding, and the like.

The pile yarns may be formed into a pile fabric using a suitable technique such as a double needle bar knit process, described below in connection with FIG. 4. Following fabric formation using a double needle bar or other suitable process the pile fabric is thereafter slit into two pile fabrics and passed through a standard tenter frame or other heat treatment apparatus. This may include a heated dye bath or the like wherein the formed fabric including the outwardly projecting pile-forming fibrous elements are subjected to an elevated temperature. In practice this elevated temperature is preferably such that the pile is raised above its glass transition temperature to effect shrinkage of pile-forming fibrous elements from yarns with high retained shrinkage potential.

Figure 4:
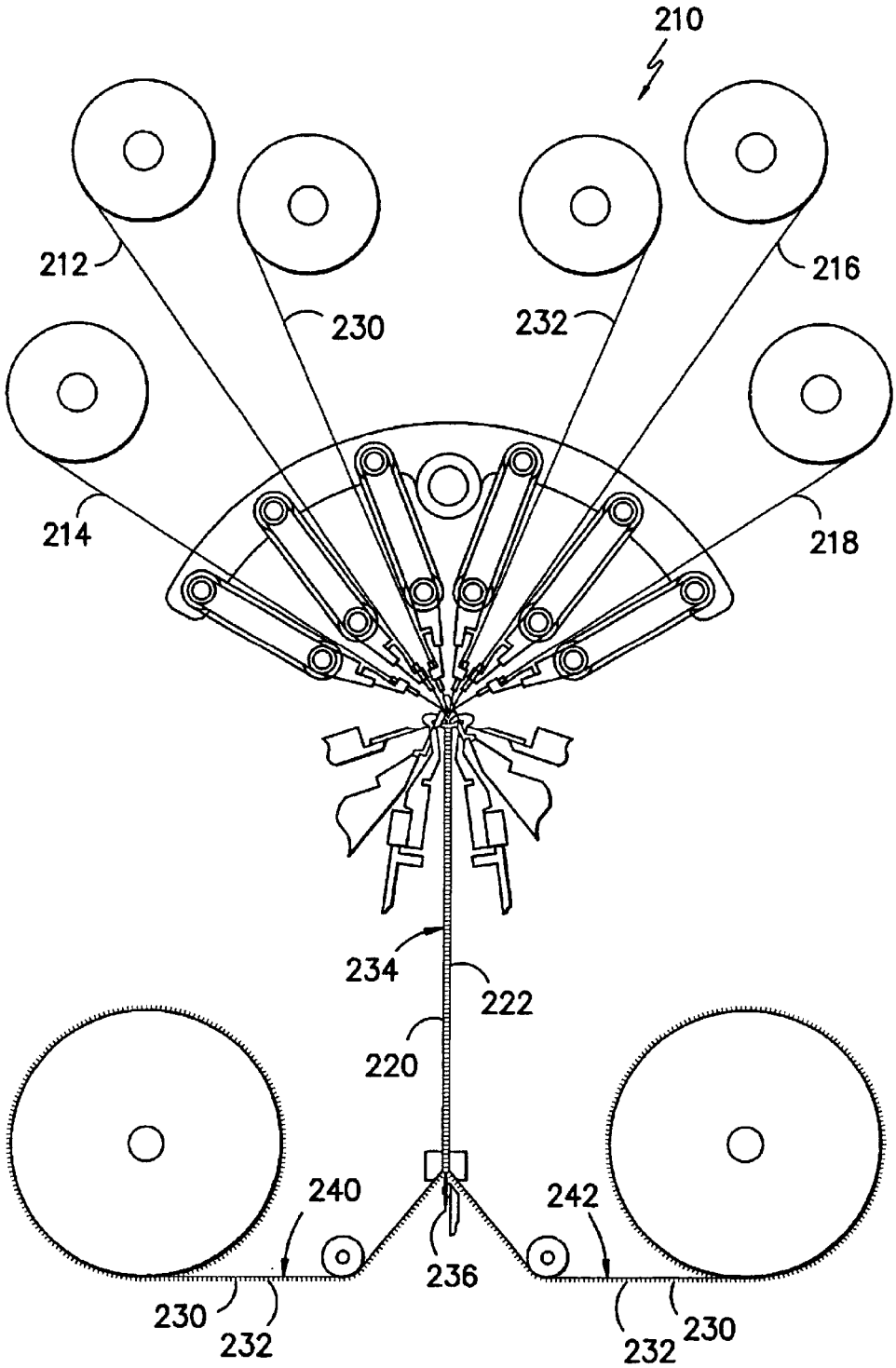
FIG. 4 illustrates one potential construction practice which can be used in the formation of the pile fabric of the invention.

In FIG. 4, there is illustrated schematically a pile fabric formation apparatus 210 such as a double needle bar knitting machine. As illustrated, in operation of the fabric formation apparatus 210 a first pair of cooperating ground yarns 212, 214 and a second pair of cooperating ground yarns 216, 218 are delivered into opposing relation and are formed into a pair of opposing base or ground fabrics 220, 222. Concurrently, with the formation of the base fabrics 220, 222 the first pile yarn 230 and a second pile yarn 232 are delivered to the fabric formation zone and are passed back and forth between the base fabrics 220, 222 to form a sandwich structure 234. The sandwich structure 234 is thereafter slit by a reciprocating or rotating blade element 236 so as to yield a pair of substantially identical pile fabrics 240, 242 having free standing pile portions formed by the fibers of the first and second pile yarns 230, 232 extending away from the base fabrics 220, 222. As shown, each of the pile fabrics 240, 242 includes portions of both the first pile yarn 230 and the second pile yarn 232. Other methods of forming a pile may be employed in the practice of the invention which do not employ a double needle bar method, and the invention is not limited to such a method.

In the practice of the invention, it is possible to apply a differential heat history on the filaments within the fiber or yarn due to the drawing of the yarn across a contact heater source. The filaments in more direct contact with the heater surface (see Zone A of FIG. 2) have a greater "heat history" than the filaments on the opposite side of the fiber bundle. This results in a differential shrinkage within the fiber bundle. By underdrawing the partially-oriented polyester (POY) yarn in Zone A, it is possible to gain the benefit of higher shrinkage and at the same time achieve greater bulk in the finished material. These "pre-stressed" yarns will still be partially oriented having an elongation at break of than about 40%.

In the practice of the invention, it is possible to improve the coverage of the ground yarns in the fabric. Furthermore, the pile height may be reduced, which may be achieved by increasing the speed of the yarn through heating Zone A, to deliver a "shock" treatment across the fiber. This "shock" treatment does not allow the fiber to crystallize to its fullest extent, forcing the fiber into a meta stable state which yields a greater differential shrinkage within the fiber, and a fiber product having greater bulk.

Figure 5:
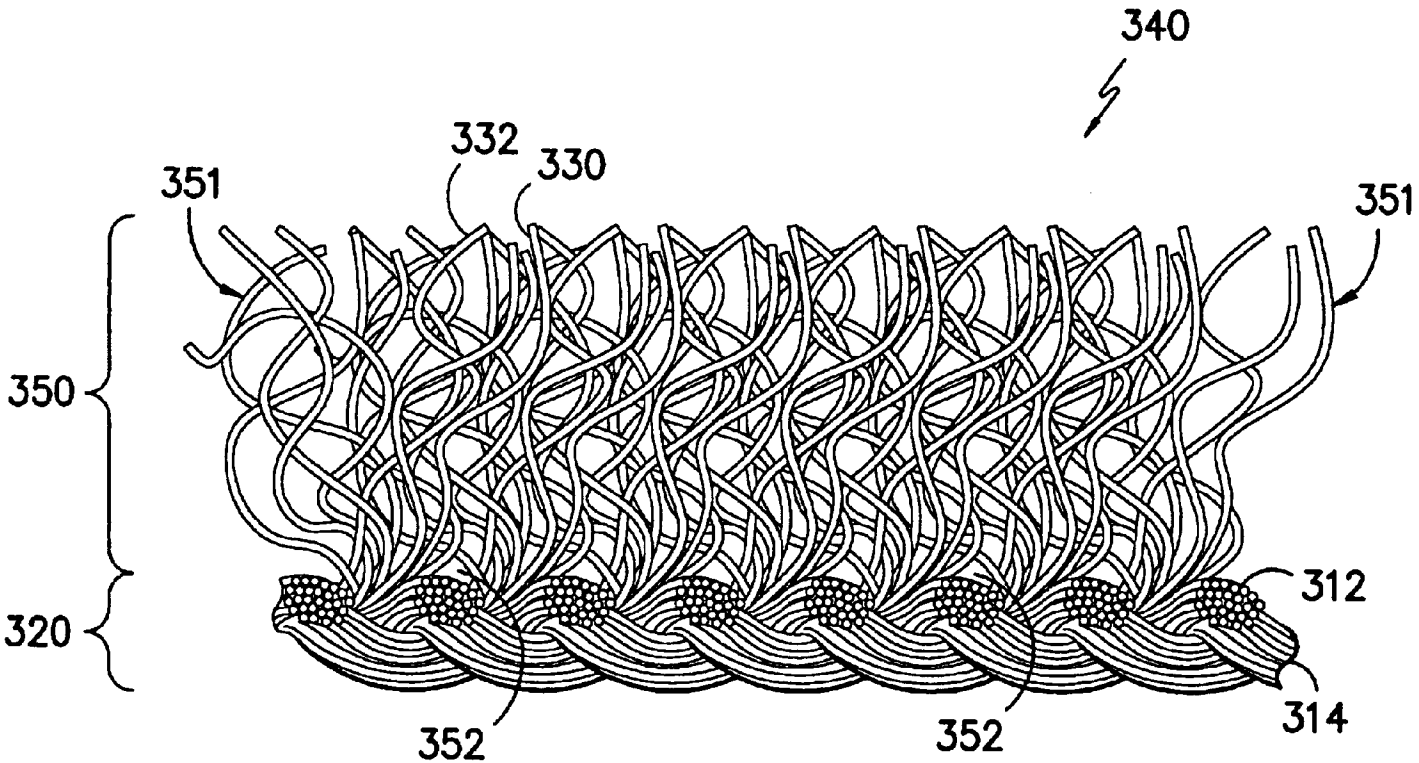
FIG. 5 illustrates a cut-away cross-sectional view of a pile fabric made according to the invention, which results in a higher bulked fiber providing reduced void space area between rows or tufts in the pile fabric.

In FIG. 5, there is illustrated a pile fabric made according to the invention. Pile fabric 340 is formed from multi-filament continuous, flat (i.e. untextured) yarns. As illustrated, the pile fabric 340 includes a base fabric layer 320 formed by the cooperating ground yarns 312, 314 and a outwardly projecting pile layer 350 formed by an arrangement of tufts 351 including the cooperating pile-forming fibrous elements of pile yarns 330, 332. As shown, in such a construction the pile-forming fibrous elements forming the pile portion 350 are generally of a substantially equivalent height across the surface of the pile fabric 340.

Moreover, at the base of the prior art pile fabric 340 in FIG. 5 there are reduced peak shaped voids 352 between the tufts 351 projecting away from the base fabric 320. These voids 352 are substantially reduced in size as compared to the voids seen, for example, in the prior art fabric illustrated in FIG. 1. Upon bending the pile fabric 340 around a sharp radius such as a bolster portion of a chair or the like, the fabric having voids which are minimized in cross-sectional area (i.e. a small average void area) provides a much greater degree of cover, and therefore is highly desirable for upholstery, automobile interiors, and other uses.

EXAMPLES

The initial fiber samples of the invention in Samples A and B of Table 2 below were run using round polyester partially oriented yarn (POY), designated M-3M001, which was obtained from Nanya Plastics Company of South Carolina USA, according to the following conditions.

Formation and processing parameters for the fabrics of Samples A and B are set forth in Table 1 below. The knitting of each was accomplished upon a 32 Gauge Double Needle Bar Warp Knitting machine. The fabric was formed in a "sandwich" structure at a six bar construction with ground yarns (forming the fabric base) carried in bars 1, 2, 5 and 6 and pile yarns carried in bars 3 and 4. The pile-forming yarns were characterized by the meta stable state, due to the heat shock effects provided in the practice of the invention.

TABLE 1

| Formation and Processing Parameters | |
|---|---|
| Back Bar Yarn | Bars 1 and 6<br>(260) 212/36 semi-dull round polyester<br>Runner Length = 120.0" |
| Mid Bar Yarn | Bars 2 and 5<br>(260) 150/36 semi-dull round polyester<br>Runner Length = 80.0" |
| Pile Bar Yarn | Bars 3 and 4<br>(175) 150/48 Full Dull Round polyester<br>Runner Length = 350.0" |
| Fabric | Inlay Stitch With Full Threading of all Bars |
| Gap Setting | 6.2 mm |
| Finishing Routing: | Slit, Greige Brush Heatset, Jet Dye, Tenter Dry |
| Slitting Machine: | Speed = 15 ft/min<br>Pile Height = 7/64"<br>Slitter Gap = 0.190 +/− 0.010 |
| Range | Greige Brush Heatset<br>Speed = 20 yds/min |
| Fabric Direction: | Slick In |
| Brush Settings: | #1 (1.0 - Reverse)<br>#2 (1.0 - Reverse)<br>#4 (1.0 - Reverse) |
| Heatset Temperatures: | Zone #1 - 420 Fahrenheit<br>Zone #2 - 415 Fahrenheit<br>Zone #3 - 415 Fahrenheit |

TABLE 1-continued

| Formation and Processing Parameters | |
|---|---|
| Jet Dye | Disperse Dye Cycle<br>Top Temperature = 266 degrees F. for 30 minutes |
| Tenter Dry | Speed = 20 yards per minute<br>Tenter Temperatures = 280 degrees Fahrenheit |

In Zone A (see FIG. 2), a hot draw was provided at temperatures shown in Table 2 below, with a draw ratio in Zone A of about 1.14. An overall (combined) draw ratio in the entire process of about 1.165 was employed. Samples A and B of the invention were prepared at different heater contact times and at different draw ratios. Results and parameters are shown below in Table 2.

TABLE 2

Samples of the Invention

| Sample | Speed (yards per minute) | Hot Draw Ratio (Zone A) | Denier | Elongation (percent) | Breaking Strength (grams) | Boiling Water Shrinkage |
|---|---|---|---|---|---|---|
| A | 600 | 1.165 @ 215 degrees C. | 151.4 | 106.26 | 368 | 12% |
| B | 500 | 1.165 @ 150 degree C. | 152.5 | 113.02 | 388 | 30% |

The products of the invention, Samples A and B, were also tested for surface coverage, i.e. average void area or space between rows, by running twelve representative samples of each. The area of the gap between the fiber tufts (rows) was determined for each sample, and then averaged. In determining the area, the degree of surface coverage upon the base portion was viewed using microscopy from an edge perspective to provide a number for the average void area between rows. A description of the protocol for gathering this void area data is provided in this specification, titled "Surface Coverage Evaluation".

Furthermore, prior art and other conventional commercial products were tested. Sample C represents a product manufactured and distributed commercially by Milliken & Company of Spartanburg, S.C. which is known as the Courtney® Fabric, Model Number 7963. This commercial product represents a variable drawn false twist textured yarn. The number of representative samples run for Sample 5 was eight. The average or mean void space between rows or tufts was found to be about 0.41 square millimeters for the Courtney® fabric. Other conventional fabric samples were tested, as shown below in Table 3.

Samples D, E, and F in Table 3 represent samples manufactured using a warp draw process known as "Hot Draw". The fibers are drawn from a "partially-oriented" state to a "fully-oriented" state by mechanical means across a contact heater surface at temperatures sufficiently above the Tg (glass-transition temperature) to set the fibers in that fully oriented state. Hot drawing provides the tuft with slightly more bloom than a mechanically-cold drawn fiber, but these products represented in samples D–F lack the bulking characteristics of the fibers and fabrics of the invention. Samples E and F In Table 3 were obtained using a fiber of gauge 44, while the examples of the invention as practiced in Samples A and B were obtained with a fiber/tuft of about 32 gauge.

Thus, the samples of the invention showed an average void area between rows which is significantly less than a textured yarn product "C" and less than a fully hot drawn warp draw product "D". At the right side of Table 3 a column is provided for the void area percentage which is calculated as the ratio of the void area in a given sample as compared to the void area of the fully hot drawn warp draw sample D. The data is presented in Table 3.

Figure 6:
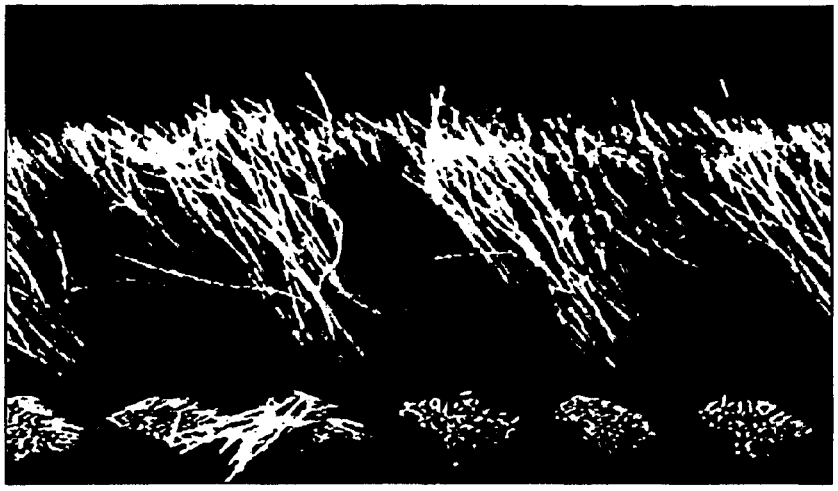
Figure -6- PRIOR ART
FIG. 6 is a photograph which is representative prior art fabric which was processed according to the technical description of a conventional prior art Sample D in Table 3 below.
Figure 7:
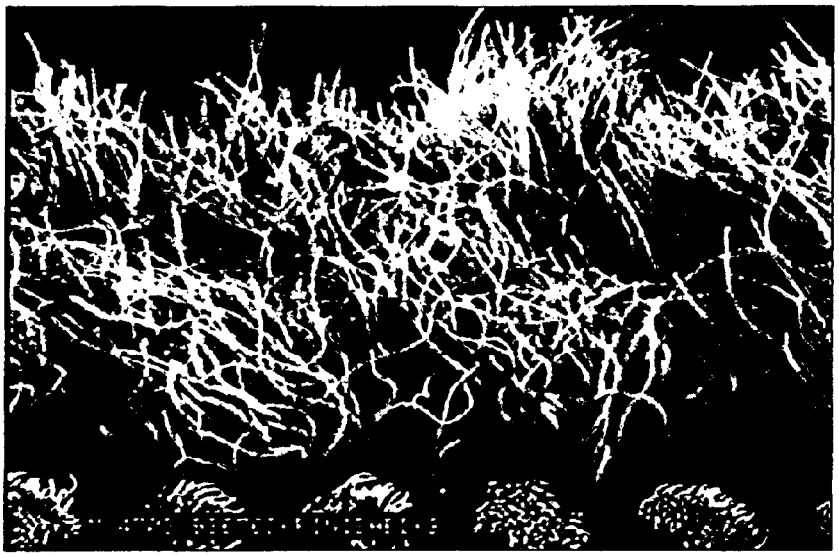
FIG. 7 is a photograph which shows one embodiment of the invention prepared according to the description below in Table 3, Sample A.

FIG. 7 shows one example of the invention corresponding to Sample A of Table 3. A visual comparison of the fabric shown in FIG. 7 to a conventional fabric shown in FIG. 6 reveals the greater degree of bulking which is achieved in the practice of the invention, as seen in FIG. 7.

TABLE 3

Void Areas Between Rows

| Sample | Average Void Area Between Rows ($mm^2$) | Void Area as a Percent Equation #3 |
|---|---|---|
| A | 0.21 | 33% |
| B | 0.35 | 53% |
| C<br>False Twist Prior Art Textured Yarn Product | 0.41 | 65% |
| D<br>Fully Hot Drawn 32 gauge (aspect ratio = 1) round structure | 0.63 | 100% |
| E<br>Fully Hot Drawn 44 gauge (aspect ratio = 1) round structure | 0.26 | 100% |
| F<br>Fully Hot Drawn 44 gauge (aspect ratio = 4) wave cross-sectional structure | 0.03 | 100% |

Surface Coverage Evaluation: Determining Average Void Area

Fabric samples were produced and prepared by cutting the edge with a razor to reveal the tufts in a coarse line. A Scanning Electron Microscope was used to capture the image of the tufts of each fabric sample. A magnification of about 25X was employed. Sample images were gathered at various locations to provide better statistical representation. Using scanning electron microscopy, photo images corresponding to 1 inch of fabric edge were transferred into IMAGE PRO PLUS version 4.5.029 software by Media Cybernetics. Using IMAGE PRO PLUS, the void areas between the fabric tufts (as seen from the edge view) were traced and filled in with bright white for the image analyzer to pick out. The area of each filled in region between tufts was then calculated using the software. About four files for each fabric sample were then averaged to yield an average void area between tufts. Average void areas were rounded to the nearest hundreds place, as above in Table 3.

What is claimed is:

1. A method of forming a pile fabric of continuous filament non-textured yarn, the method comprising the steps of:

(a) providing a continuous filament non-textured yarn, (b) heating and drawing simultaneously said continuous filament non-textured yarn to pre-stress said yarn;

(c) providing a base portion, (d) forming said continuous filament non-textured yarn, which has been pre-stressed, into a plurality of tufts upon said base portion such that said tufts and said base portion define a fabric, and (e) heating said fabric, thereby providing a bulked pile fabric.

2. The method of claim 1 wherein said drawing step comprises underdrawing said yarn.

3. The method of claim 1 wherein said heating and drawing step (b) is accomplished at a temperature of greater than about 150 degrees C.

4. The method of claim 1 wherein said heating and drawing step (b) is accomplished at a temperature of greater than about 180 degrees C.

5. The method of claim 1 wherein said heating and drawing step (b) is accomplished at a temperature of greater than about 200 degrees C.

6. The method of claim 1 wherein said heating and drawing step (b) is accomplished at a temperature of about 215 degrees C. or greater.

7. The method of claim 1 wherein said heating and drawing step (b) is conducted by employing a heating time of no greater than about 0.063 seconds.

8. The method of claim 1 wherein said heating and drawing step (b) is conducted by employing a heating time of no greater than about 0.056 seconds.

9. The method of claim 1 wherein said heating and drawing step (b) is conducted by employing a heating time of no greater than about 0.052 seconds.

10. The method of claim 1 wherein said heating and drawing step (b) is conducted by employing a heating time of no greater than about 0.047 seconds.

11. A method of forming a pile fabric, the method comprising the steps of:

(a) providing a continuous filament non-textured yarn;

(b) simultaneously (i) heating said yarn at greater than about 100 degrees Centigrade, and (ii) underdrawing said continuous filament non-textured yarn, thereby pre-stressing said yarn;

(c) providing a base portion;

(d) forming said pre-stressed continuous filament non-textured yarn into a plurality of tufts upon said base portion such that said tufts and said base portion define a fabric structure; and (e) heating said fabric structure.

12. The method of claim 11 wherein said heating time/drawing time in step (b) is no greater than about 0.063 seconds.

13. The method of claim 11 wherein said heating/drawing time in step (b) is no greater than about 0.052 seconds.

14. A method of forming a pile fabric, the method comprising the steps of:

(a) providing a continuous filament non-textured yarn;

(b) simultaneously (i) heating said yarn at a temperature of at least about 200 degrees Centigrade, and (ii) drawing said continuous filament non-textured yarn at a draw ratio of greater than about 1.0 by employing a heating/drawing contact time of no greater than about 0.063 seconds;

(c) providing a base portion;

(d) forming said continuous filament non-textured yarn into a plurality of tufts upon said base portion such that said tufts and said base portion define a fabric structure; and (e) heating said fabric structure.

15. The method of claim 14 wherein said heating/drawing contact time is no greater than about 0.056 seconds.

16. The method of claim 14 wherein said heating/drawing contact time is no greater than about 0.052 seconds.

17. The method of claim 14 wherein said fabric structure produced in step (e) provides an average void area between said tufts of less than about 0.41 square millimeters.

18. The method of claim 17 wherein said average void area is between about 0.21 and about 0.41 square millimeters.

19. The method of claim 17 wherein said average void area is between about 0.21 and about 0.35 square millimeters.

20. The method of claim 17 wherein said average void area is about 0.35 square millimeters or less.

* * * * *